US011465809B1

(12) United States Patent
Herrington

(10) Patent No.: US 11,465,809 B1
(45) Date of Patent: Oct. 11, 2022

(54) GRIPPING DEVICE FOR PLASTIC BAGS AND METHOD OF USE

(71) Applicant: Gregory Alan Herrington, Weatherford, TX (US)

(72) Inventor: Gregory Alan Herrington, Weatherford, TX (US)

( * ) Notice: Subject to any disclaimer, the term of this patent is extended or adjusted under 35 U.S.C. 154(b) by 0 days.

(21) Appl. No.: 17/387,767

(22) Filed: Jul. 28, 2021

(51) Int. Cl.
*B65D 33/00* (2006.01)

(52) U.S. Cl.
CPC ..... *B65D 33/007* (2013.01)

(58) Field of Classification Search
CPC .... B65D 33/07; B65D 33/005; B65D 33/007; B65F 1/002; B65B 43/30; B42D 9/04
USPC ..... 383/35; 15/104.94; 2/21; 294/25
See application file for complete search history.

(56) References Cited

U.S. PATENT DOCUMENTS 2,197,113 A * 4/1940 Piazze ..... B65D 33/007 383/35
3,985,383 A * 10/1976 Yonkers ..... B42D 9/04 2/21
5,894,947 A * 4/1999 Morano ..... B65D 33/007 383/103
2003/0138171 A1* 7/2003 Kikuchi ..... B65D 33/007 383/63
2004/0010217 A1* 1/2004 Blette ..... B29C 37/0053 602/54
2015/0197375 A1* 7/2015 Pontoriero ..... B65D 33/007 235/494
2019/0337679 A1* 11/2019 Gontz ..... B65D 33/002

FOREIGN PATENT DOCUMENTS

FR 2998277 A1 * 5/2014 ..... B65D 33/007
GB 2271756 A * 4/1994 ..... B65D 33/007
GB 2314316 A * 12/1997 ..... B65D 33/007
JP 08026299 A * 1/1996 ..... B65D 33/007
WO WO-2004000572 A1 * 12/2003 ..... B42D 9/04
WO WO-2009108078 A2 * 9/2009 ..... B05B 14/30

* cited by examiner

*Primary Examiner* — Jes F Pascua
*Assistant Examiner* — Nina K Attel
(74) *Attorney, Agent, or Firm* — Leavitt Eldredge Law Firm

(57) ABSTRACT

A gripping device for enabling users to open a plastic bag more readily is disclosed. In one embodiment, the gripping device comprises a top half and a bottom half, wherein both halves include a base having a plurality of bristles. The base is configured to engage with one side of the mouth of a plastic bag via an attachment means, and is configured to allow the placement of a user's fingertip thereon. In another embodiment, the gripping device comprises a top half and a bottom half, wherein both halves include a base having a grip surface. The base is configured to engage with one side of the mouth of a plastic bag. The grip surface is configured to allow the placement of a user's fingertip thereon and configured to prevent the user's fingertips from slipping therefrom.

2 Claims, 5 Drawing Sheets

GRIPPING DEVICE FOR PLASTIC BAGS AND METHOD OF USE

BACKGROUND

1. Field of the Invention

The present invention relates generally to plastic bags, and more specifically to a gripping device that enables a user to open a plastic bag more readily.

2. Description of Related Art

Grocery stores and markets often provide plastic bags to consumers to enable the consumers to place items (e.g., produce, meats, physical goods, etc.) into such plastic bags for purchase and for easy transportation. Typically, plastic bags are connected sequentially along perforated lines and wound onto a cylindrical-shaped roll and placed into a plastic bag dispenser. A consumer typically tears the leading plastic bag along the perforated line to separate the leading plastic bag from the roll.

One of the problems commonly associated with plastic bags is that once the leading plastic bag is removed from the roll, it is difficult and often time-consuming to open the mouth of the plastic bag. This is partly due to the side walls of the plastic bag adhering together due to static. Consumers generally resort to wetting their fingertips, often with saliva, and then rubbing the bag to produce enough friction to open up the bag. However, this technique is unsanitary and is often employed after consumers become frustrated from failing to open the bag initially. Hence, a solution is needed to address these issues.

Accordingly, although great strides have been made in the area of plastic bags, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
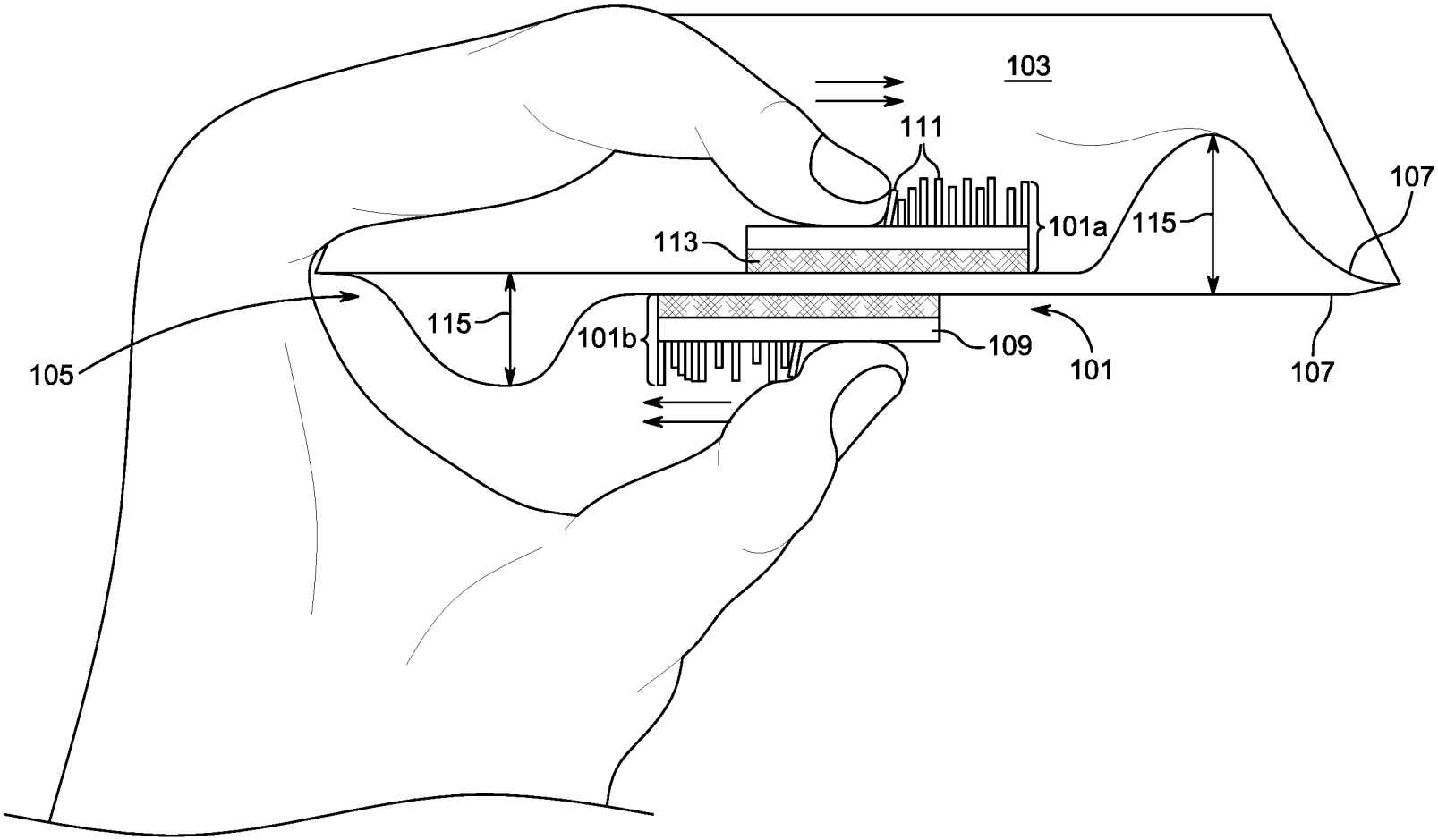
FIG. 1 is a front view of a gripping device in accordance with one or more embodiments of the present invention, with the gripping device enabling a user to open a plastic bag.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional plastic bags. Specifically, the present invention facilitates the opening of plastic bags more readily. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein like reference characters identify corresponding or similar elements throughout the several views, FIG. 1 depicts a front view of a gripping device 101 for enabling a user in opening a plastic bag 103 in accordance with a preferred embodiment of the present application. It will be appreciated that the gripping device 101 overcomes one or more of the above-listed problems commonly associated with conventional plastic bags.

In the contemplated embodiment, the gripping device 101 comprises a top half 101*a* and a bottom half 101*b*. Both halves 101*a*, 101*b* include a base 109 with a plurality of bristles 111 fixedly attached thereto. The base 109 adheres to the opposing sides 107 of the mouth 105 of a plastic bag 103 through an attachment mechanism 113. It should be appreciated that the attachment mechanism 113 may be frictional interference-based, adhesive-based, fastener-based, or other attachment-based techniques suitable to allow the base 109 to adhere to the plastic bag 103.

It should be appreciated that the plurality of bristles 111 cover the surface of the base 109 partially. While the plurality of bristles 111 cover approximately half of the surface of the base 109, as shown in FIG. 1, it is contemplated that the coverage of the plurality of bristles 111 may vary.

In some embodiments, it should be appreciated that the plurality of bristles 111 may be integrally formed as part of the base 109 or it may be separately formed and engaged therewith (e.g., by adhesives or cements; by welding, brazing, soldering, or other fusing techniques; by mechanical connectors; etc.). It should also be appreciated that the plurality of bristles 111 may be made of material suitable to provide grip for the user's fingertips including, without limitation, natural rubber, synthetic rubber, a combination thereof, and other materials.

It should be appreciated that the gripping device 101 may vary based on aesthetical, functional, or manufacturing considerations.

It should be appreciated that during use, the user can open the plastic bag 103 by placing his or her fingertips against the base 109 of halves 101*a*, 101*b*, and sliding the halves 101*a*, 101*b* anti-parallel across the mouth 105, as shown with directional arrows. The sliding creates one or more gaps 115, allowing the user to open the plastic bag 103.

It should also be appreciated that one of the unique features believed characteristic of the present application is that it provides a sanitary and easy means for enabling users to open a plastic bag without wetting their fingertips as well as relieving their frustrations associated with opening plastic bags.

Figure 2:
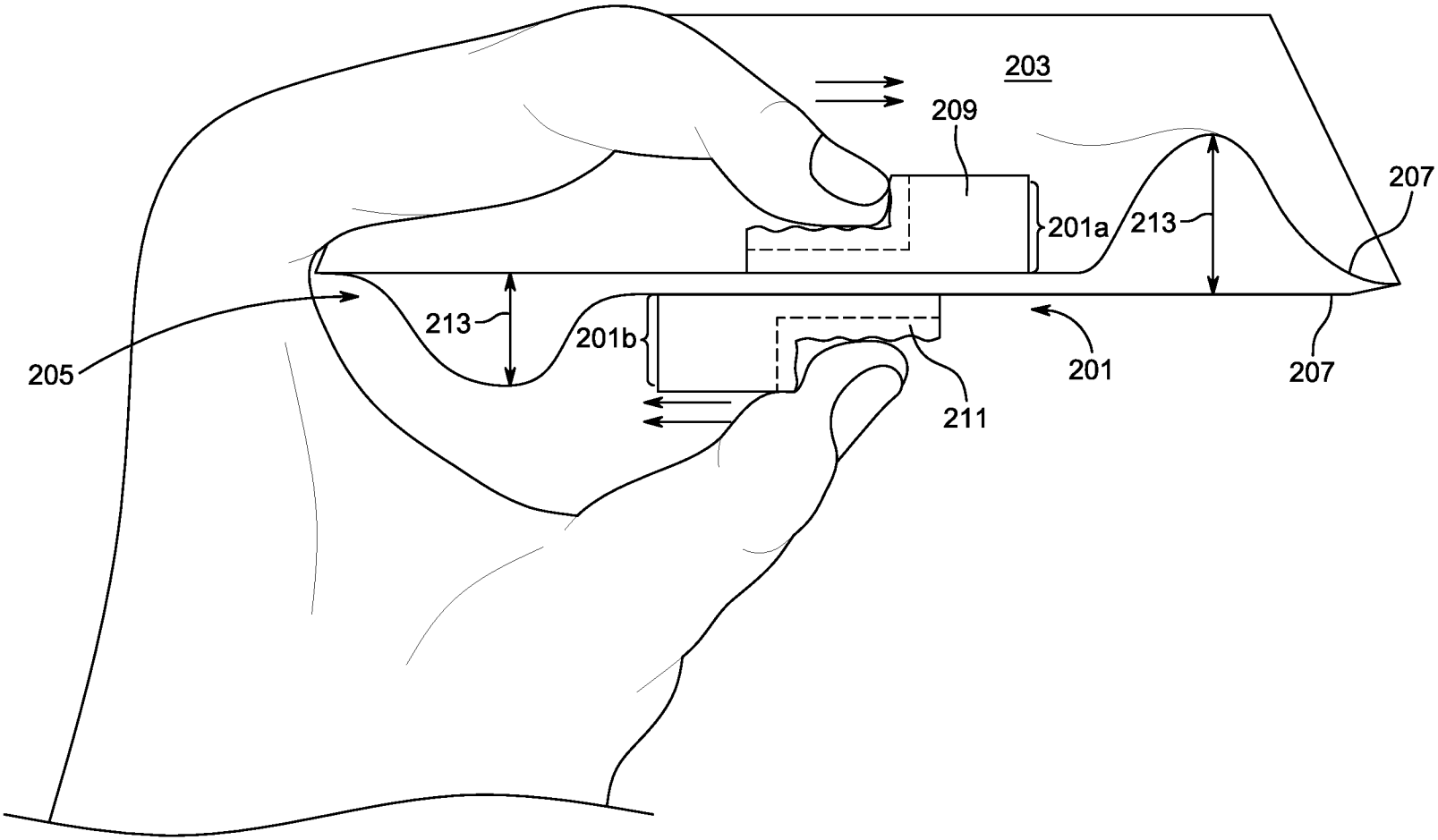
FIG. 2 is a front view of an alternative gripping device in accordance with one or more embodiments of the present invention, with the alternative gripping device enabling a user to open a plastic bag.

FIG. 2 is a front view of an alternative gripping device 201 for enabling a user in opening a plastic bag 203 in accordance with one or more embodiments of the present invention. As shown, the gripping device 201 comprises a top half 201*a* and a bottom half 201*b*. Both halves 201*a*, 201*b* include a base 209 having a grip surface 211. The grip surface 211 is configured to allow the placement of the user's fingertips thereon and to prevent the user's fingertips from slipping therefrom. The base 209 engages with opposing sides 207 of the mouth 205 of a plastic bag 203. It should be appreciated that the base 209 engagement with the opposing sides 207 may be frictional interference-based, adhesive-based, fastener-based, or other attachment-based techniques.

In some embodiments, it should be appreciated that the grip surface 211 may be integrally formed as part of the base 209 or it may be separately formed and engaged therewith (e.g., by adhesives or cements; by welding, brazing, soldering, or other fusing techniques; by mechanical connectors; etc.). It should also be appreciated that the grip surface 211 may be made of material suitable to provide grip for the user's fingertips including, without limitation, natural rubber, synthetic rubber, a combination thereof, and other materials.

It should be appreciated that the gripping device 101 may vary based on aesthetical, functional, or manufacturing considerations.

It should be appreciated that during use, the user can open the plastic bag 203 by placing his or her fingertips against the grip surface 211 of halves 201*a*, 201*b*, and sliding the halves 201*a*, 201*b* anti-parallel across the mouth 205, as shown with directional arrows. The sliding creates one or more gaps 213, allowing the user to open the plastic bag 203.

Figure 3:
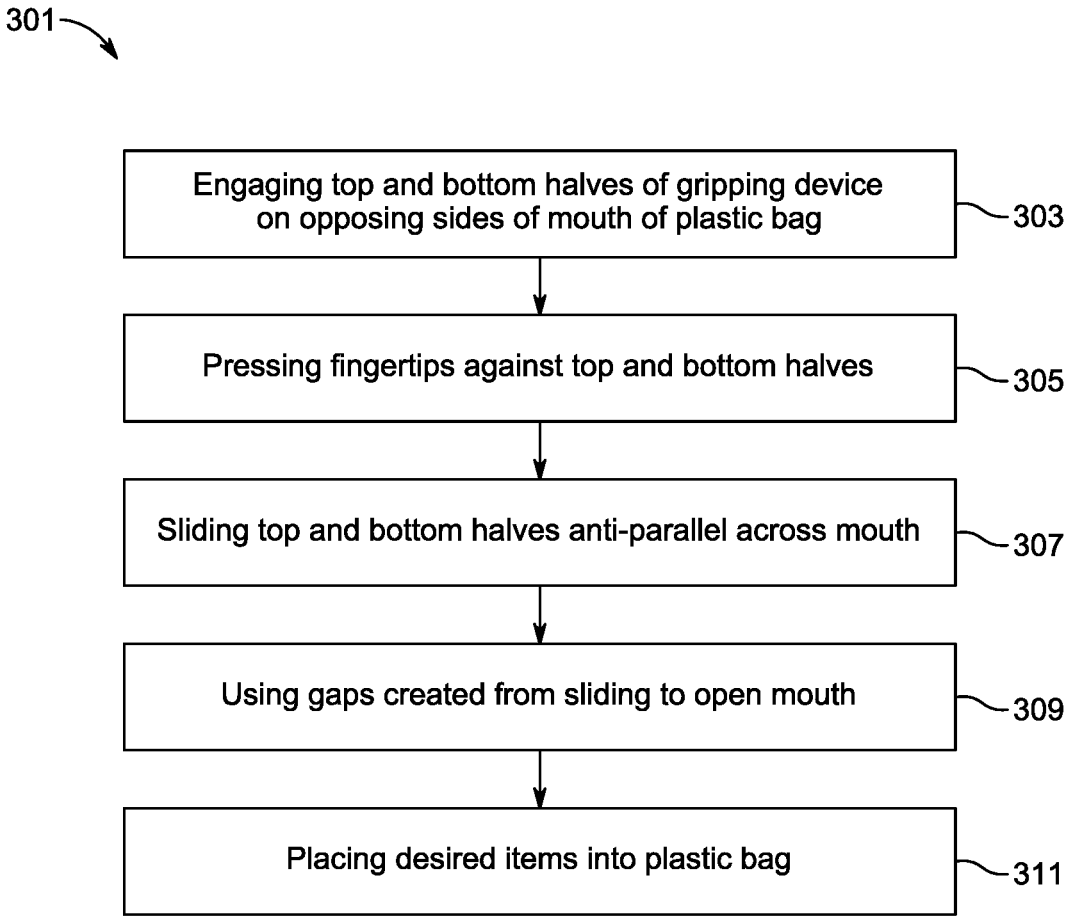
FIG. 3 is a flowchart of a method of use in accordance with one or more embodiments of the present application.

In FIG. 3, a flowchart 301 depicts a simplified method of use associated with the present application. During use, the top and bottom halves of the gripping device engage on the opposing sides of the mouth of the plastic bag, as shown with box 303. The user then presses his or her fingertips against the top and bottom halves to slide anti-parallel across the mouth, as shown with boxes 305, 307. The user may then use the gaps created from the sliding motion to open the mouth fully and proceed to place any desired items into the plastic bag, as shown with boxes 309, 311.

Figure 4A:
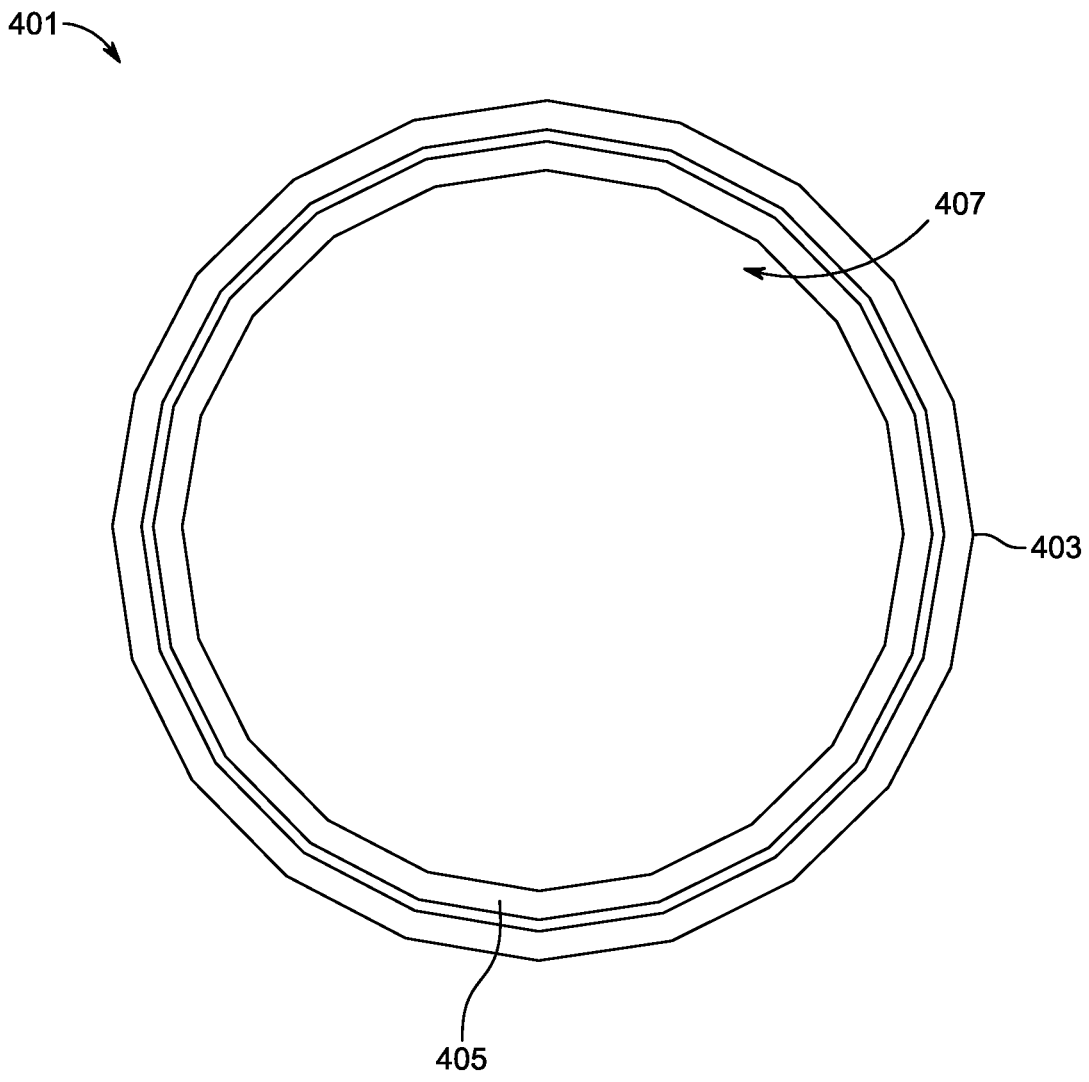
FIG. 4A is a front view of another gripping device in accordance with one or more embodiments of the present invention.
Figure 4B:
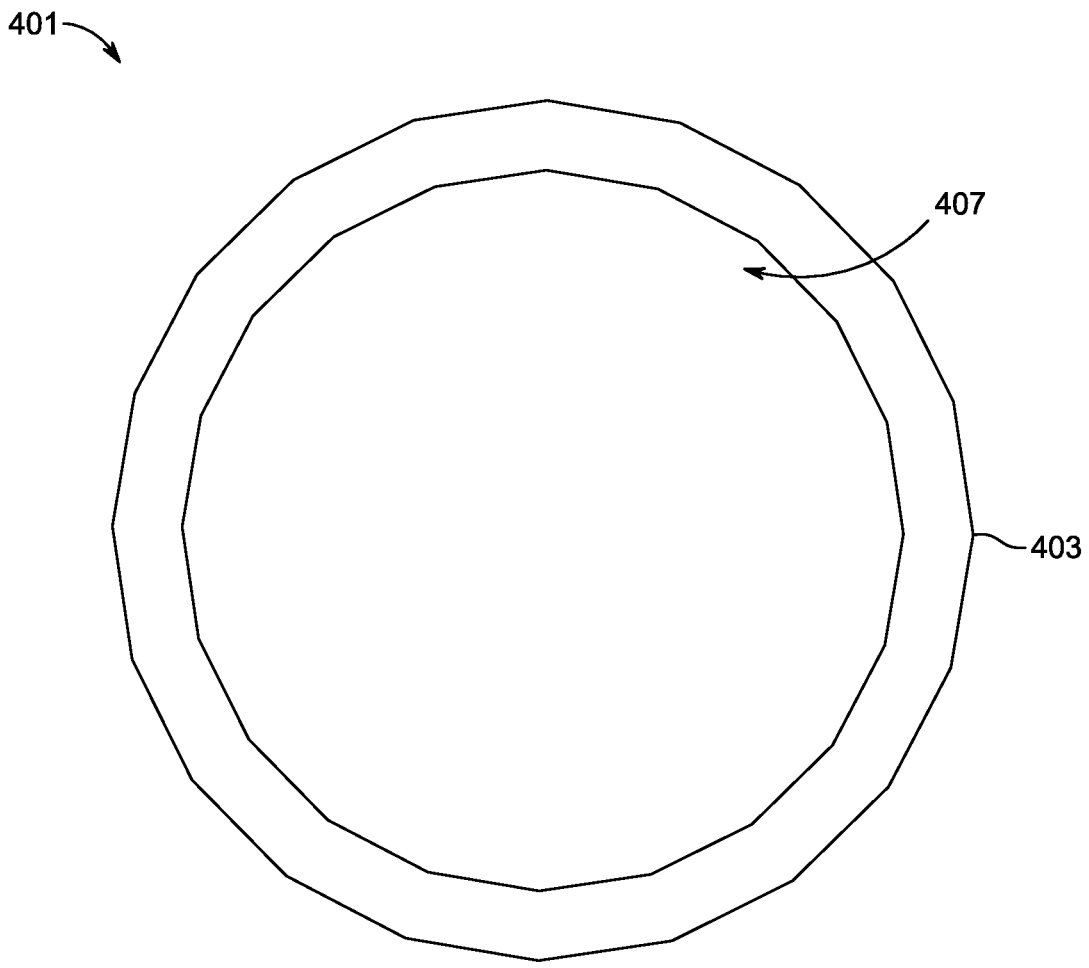
FIG. 4B is a rear view of another gripping device in accordance with one or more embodiments of the present invention.

In FIGS. 4A and 4B, a front view and a rear view of another gripping device 401 are shown, respectively. As shown, the gripping device 401 includes an outer ring 403 having an inner ring 405 recessed therein. The inner ring 405 is configured to define a hollow cavity 407 therein and configured to allow the receipt of a user's fingertip. In the preferred embodiment, the gripping device 401 includes the following dimensions: 10 mm outer diameter, 8 mm top inner diameter, and 7 mm bottom inner diameter.

It should be appreciated that the gripping device 401 may vary based on aesthetical, functional, or manufacturing considerations.

It should be appreciated that during use, the gripping device 401 is engaged with one side of a plastic bag. The user can open a plastic bag by placing his or her fingertip within the hollow cavity 407 and make sliding movements along the side of the plastic bag.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A gripping device for enabling a user to open a plastic bag, comprising:

a top half, the top half having:

a first base configured to engage with a first side of a mouth of a plastic bag via an attachment means, wherein the attachment means is configured to adhesively secure to the mouth of the bag, and wherein the first base has a length that extends from a first end to a second end; and a first plurality of bristles coupled to the first base and extending therefrom, wherein the first plurality of bristles are positioned solely at half of the length of the first base, and wherein the other half of the length of the first base without the plurality of bristles is configured to allow the placement of the fingertip of the user thereon; and a bottom half, the bottom half having:

a second base configured to engage with an opposing side of the mouth of the plastic bag via an attachment means, and configured to allow the placement of another fingertip of the user thereon; and a second plurality of bristles coupled to the second base.

2. A method of opening a plastic bag, the method comprising:

providing the device of claim 1;

engaging the top and bottom halves with the first side and the opposing side of the mouth;

pressing the user's fingertips against the top and bottom halves;

sliding the top and bottom halves anti-parallel across the mouth;

using one or more gaps created to open the mouth; and placing one or more items into the plastic bag as desired.

* * * * *